US012116542B2

(12) United States Patent
Soderberg et al.

(10) Patent No.: US 12,116,542 B2
(45) Date of Patent: Oct. 15, 2024

(54) CATALYSIS OF THE REACTION BETWEEN HYDROGEN SULFIDE SCAVENGERS AND HYDROGEN SULFIDE USING TERTIARY AMINES

(71) Applicant: CANADIAN ENERGY SERVICES L.P., Calgary (CA)

(72) Inventors: Jeffrey Soderberg, Calgary (CA); Hossein Jozani, Calgary (CA)

(73) Assignee: Canadian Energy Services L.P., Calgary (CA)

( * ) Notice: Subject to any disclaimer, the term of this patent is extended or adjusted under 35 U.S.C. 154(b) by 0 days.

(21) Appl. No.: 18/342,057

(22) Filed: Jun. 27, 2023

(65) Prior Publication Data

US 2023/0416630 A1 Dec. 28, 2023

Related U.S. Application Data

(60) Provisional application No. 63/355,835, filed on Jun. 27, 2022.

(51) Int. Cl.
*C10L 10/04* (2006.01)
*C10L 1/223* (2006.01)

(52) U.S. Cl.
CPC ..... *C10L 10/04* (2013.01); *C10L 1/223* (2013.01); *C10L 2200/0259* (2013.01)

(58) Field of Classification Search
CPC ..... C10L 10/04; C10L 1/223; C10L 2200/0259
USPC ..... 585/2
See application file for complete search history.

(56) References Cited

U.S. PATENT DOCUMENTS

| | | | | |
|---|---|---|---|---|
| 5,347,004 | A | 9/1994 | Rivers et al. | |
| 5,554,349 | A | 9/1996 | Rivers et al. | |
| 6,582,624 | B2 | 6/2003 | Titley et al. | |
| 2013/0004393 | A1* | 1/2013 | Menendez | B01D 53/52 210/749 |
| 2021/0198129 | A1* | 7/2021 | Maltas | C02F 1/683 |
| 2023/0340339 | A1 | 10/2023 | Soderberg et al. | |

OTHER PUBLICATIONS

Sulfaguard 4563 H2S Scavenger—Brenntag Canada (WIL-Chem Stanchem Travis) Safety Data Sheet, May 28, 2018.

(Continued)

*Primary Examiner* — Prem C Singh
*Assistant Examiner* — Francis C Campanell
(74) *Attorney, Agent, or Firm* — Bennett Jones LLP

(57) ABSTRACT

While some triazines have low reactivity, a method and composition is described for improving their reactivity. The $H_2S$ scavenging composition and method utilizes a tertiary amine to catalyze the scavengers with slower kinetics to achieve improved results over traditional systems with the scavenger alone. A hydrogen sulfide scavenging composition comprises: a tertiary amine as a catalyst in at least one of (i) a triazine scavenger selected from the group consisting of: methyl amine, C2-C5 alkyl amine, dimethylaminopropylamine, isopropanolamine, aniline, cyclohexylamine, isobutanolamine and methoxypropylamine triazines/bisoxazolidines; or (ii) an aldehyde-based scavenger such as glyoxal.

8 Claims, 5 Drawing Sheets

(56) References Cited

OTHER PUBLICATIONS

Taylor et al., Amorphous Polymeric Dithiazine apDTZ Solid Fouling: Critical Review, Analysis and Solution of an Ongoing Challenge in Triazine-Based HydrogenSulphide Mitigation, Society of Petroleum Engineers, SPE-204397-MS, Dec. 2021, pp. 1-15, the Woodlands, Texas, USA.

Wylde et al., Formation, Chemical Characterization, and Oxidative Dissolution of Amorphous Polymeric Dithiazine (apDTZ) during the Use of the H2S Scavenger Monoethanolamine-Triazine, Heriot-Watt University Research Gateway, Energy and Fuels, vol. 34, No. 8, pp. 9923-9931, https://doi.org/10.1021/acs.energyfuels.0c01402.

Matherly et al., The Evaluation and Optimization of Hydrogen Sulfide Scavenger Applications Using Ion Mobility Spectrometry, Society of Petroleum Engineers, SPE 164133, Apr. 2013, pp. 1-10, the Woodlands, Texas, USA.

Taylor et al., The Formation and Chemical Nature of Amorphous Dithiazine Produced From Use Of Hexahydrotriazine Based Hydrogen Sulfide Scavengers and the Use of an Alternative Scavenger to Minimize Solid Formation in Sour Gas Applications, Society of Petroleum Engineers, SPE 164134, Apr. 2013, pp. 1-14, the Woodlands, Texas, USA.

Taylor et al., The Laboratory Evaluation and Optimization of Hydrogen Sulphide Scavengers Using Sulphur Specific Flame Photometric Gas Chromatography, Society of Petroleum Engineers, SPE 140401, Apr. 2011, pp. 1-11, the Woodlands, Texas, USA.

Taylor et al., Identification of the Molecular Species Responsible for the Initiation of Amorphous Dithiazine Formation in Laboratory Studies of 1,3,5-Tris (hydroxyethyl)-hexahydro-s-triazine as a Hydrogen Sulfide Scavenger, Industrial & Engineering Chemistry Research, American Chemical Society, Aug. 2, 2012, 51, pp. 11613-11617, Texas, USA.

Taylor et al., Use of Portable Analytical Methods to Determine the Stoichiometry of Reaction for Hexahydrotriazine-Based Hydrogen Sulfide Scavenger Operations, Analytical Chemistry, American Chemical Society, Apr. 28, 2014, 86, 4879-4882, Texas, USA.

Taylor et al., Progress Towards an Oil and Gas Industry Alternative to Mea Triazine in Hydrogen Sulfide Mitigation, Society of Petroleum Engineers, SPE-191566-MS, Sep. 2018, pp. 1-14, Dallas, Texas, USA.

* cited by examiner

CATALYSIS OF THE REACTION BETWEEN HYDROGEN SULFIDE SCAVENGERS AND HYDROGEN SULFIDE USING TERTIARY AMINES

FIELD

The invention is directed to methods and compositions for scavenging hydrogen sulfide from a fluid stream.

BACKGROUND

The hydrogen sulfide content of a fluid from an oil and gas well has an important impact on the economic value of the produced hydrocarbons and productions operations. Hydrogen sulfide is dangerous to personnel as it is extremely toxic to humans. In addition, hydrogen sulfide is extremely corrosive to most metals. It can cause corrosion problems in transport pipes, storage tanks, and other metal components. It causes sulfide stress cracking, hydrogen embrittlement and pitting corrosion in oil and gas operations.

The removal of hydrogen sulfide from oil and gas streams is often required in order to meet many pipeline and storage regulations. A number of processes are available to remove hydrogen sulfide from hydrocarbon streams using chemical agents. These chemical agents react with one or more sulfide species and convert them to a more inert form. These chemical agents are known in the industry as hydrogen sulfide scavengers. Hydrogen sulfide scavengers can be in a solid or liquid form. Liquid scavengers may be regenerative scavengers such as amine wash or reduction oxidation or non-regenerative scavengers such as aldehydes, triazines, and sodium nitrates, as examples. When the hydrogen sulfide concentration is low, non-regenerative liquid scavengers are often used. A large number of non-regenerative chemical formulations exist for removal of hydrogen sulfide.

One important group and the most frequently used liquid hydrogen sulfide scavengers are hexahydrotriazine-based hydrogen sulfide scavengers. These are commonly referred to in the industry as triazine scavengers. Triazines are readily deployed in scrubbers and are effective scavengers. Triazine is a heterocyclic structure similar to cyclohexane but with three carbons replaced by nitrogen atoms.

In one example, a water-based liquid hydrogen sulfide scavenger containing triazine is used in a contactor tower or scrubber. The hydrocarbon feed gas is bubbled through the contactor. As the hydrocarbon gas bubbles up through the liquid, the hydrogen sulfide reacts with the triazine and the hydrogen sulfide is removed from the hydrocarbon gas stream. The outlet gas from the contactor has a lower concentration of hydrogen sulfide than the feed gas.

The most common triazine used as a hydrogen sulfide scavenger is based on monoethanolamine. It is known as MEA triazine. MEA triazine is a very fast acting scavenger and, therefore, is well received by industry.

Other triazines are available such as methyl amine (MMA) triazine, other alkyl amine (C2-C5) triazines, dimethylaminopropylamine (DMAPA) triazine, isopropanolamine triazine, aniline triazine, cyclohexylamine triazine, isobutanolamine triazine and methoxypropylamine (MOPA) triazine. However, these other triazines are slower reacting compared to MEA triazine. Therefore, while available they are not as frequently used.

In addition, other scavengers such as glyoxal and other aldehyde-based scavengers are available but are also slower reacting compared to MEA triazine. Glyoxal is a chemical according to the following structure:

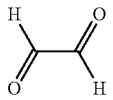

Despite the widespread use of MEA triazine scavenger in industry, any improvement to expand the usefulness of the other less reactive triazine and aldehyde scavengers is of interest.

SUMMARY

In one aspect of the present invention, a tertiary amine catalyst is employed for a hydrogen sulfide scavenger to improve its reactivity for scavenging $H_2S$ from a fluid stream, such as a hydrocarbon gas or liquid stream.

In particular, in one aspect there is provided a hydrogen sulfide scavenging composition comprising: a tertiary amine; and a scavenger selected from the group consisting of: triazines/bisoxazolidines based on methyl amine, C2-C5 alkyl amine, dimethylaminopropylamine, isopropanolamine, aniline, cyclohexylamine, isobutanolamine and methoxypropylamine, glyoxal and other aldehydes.

In another aspect there is provided a method for scavenging hydrogen sulfide from a sour hydrocarbon fluid comprising: contacting the sour hydrocarbon fluid with a hydrogen sulfide scavenging composition comprising: a tertiary amine; and a scavenger selected from the group consisting of: triazines/bisoxazolidines based on methyl amine, C2-C5 alkyl amine, dimethylaminopropylamine, isopropanolamine, aniline, cyclohexylamine, isobutanolamine and methoxypropylamine, glyoxal and other aldehydes.

DETAILED DESCRIPTION OF THE INVENTION

Figure 1:
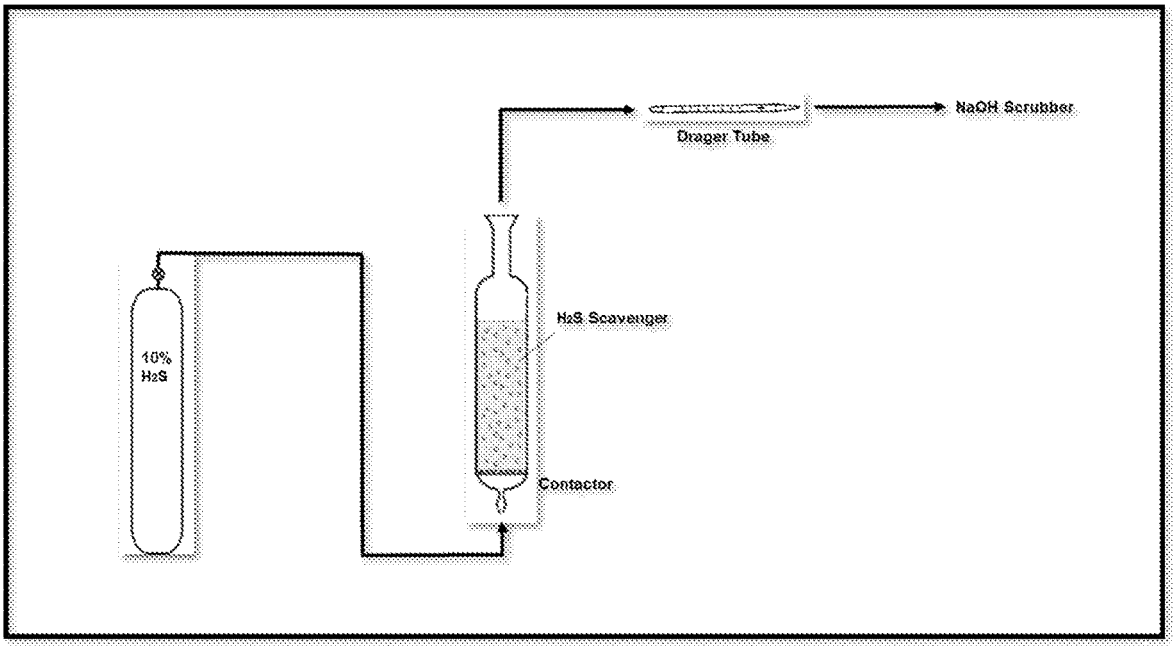
FIG. 1 is a schematic of the H2S breakthrough test setup.

In one embodiment, the present invention provides a new hydrogen sulfide scavenger composition comprising a scavenger chemistry catalyzed by a tertiary amine. The invention is particularly useful for improving the reactivity of less reactive scavengers.

In one embodiment, the $H_2S$ scavenger is a substituted triazine scavenger including methyl amine (MMA) triazine, other alkyl amine (C2-C5) triazines, dimethylaminopropylamine (DMAPA) triazine, isopropanolamine triazine, aniline triazine, cyclohexylamine triazine, isobutanolamine triazine or methoxypropylamine (MOPA) triazine. The foregoing triazines have been considered to have slow reactivity, in particular a reactivity much less than that of monoethanolamine (MEA) triazine, and a modification that will increase their reactivity is of interest.

Triazines are the reaction products of three moles of amine with three moles of formaldehyde. Thus, it is to be understood that a mixture of formaldehyde and the above-noted amines is captured by the terms "triazine" and "triazine-based scavenger" and the like.

For certain hydroxyalkyl amines, reaction of three moles of formaldehyde with two moles of a hydroxyalkyl amine followed by dehydration can result in a biscyclized bridged moiety. As an example, three moles of formaldehyde reacted with two moles of isopropanolamine produces bisoxozolidine (oxazolidine, 3,3'-methylenebis[5-methyl-]). Note that in aqueous solution, the bisoxozolidine behaves as if it were isopropanolamine triazine with an excess of formaldehyde. Thus, herein it is to be understood that "triazine", "triazine-based scavenger" and the like terms, include bisoxozolidines.

In another embodiment, the $H_2S$ scavengers are aldehyde-based, including, but not limited to glyoxal, acrolein and others.

The addition of a tertiary amine has been found to improve the reaction between the scavenger and $H_2S$. While it is not necessary to identify the mode of the effect, it is believed that the added tertiary amine acts as a catalyst for the reaction of the scavenger chemistry and $H_2S$. In particular, with reference to triazines, unlike primary amines which would form triazines (when reacted with formaldehyde), tertiary amines such as triethylamine, tripropylamine and tributylamine have been found not to react with formaldehyde. Therefore, although it is not intended that the invention be limited by the theory, it is believed that the improved performance with the addition of amine to the scavenger is catalytic in nature.

The tertiary amines are useful in catalytic amounts, such as up to 10% by volume in the scavenger. For example, concentrations of 0.05 to 8.0% or 0.1 to 5.5% by volume are useful to catalyze the reaction between a triazine-based or aldehyde-based scavenger and $H_2S$.

The tertiary amines of greatest interest are triethylamine (TEA), tripropylamine (TPA), tributylamine (TBA) and dimethylaminopropylamine (DMAPA). It would be appreciated that DMAPA may not be useful to catalyze the reaction of a DMAPA triazine with $H_2S$.

While the $H_2S$ scavengers and tertiary amines are the reactants of interest in this invention, it will be appreciated that a hydrogen sulfide scavenger composition may contain other chemicals such as methanol, glycol, etc.

The following examples show that the reaction of MMA triazine or glyoxal with $H_2S$ can be catalyzed using triethylamine. The beneficial effect of tripropylamine and dimethylaminopropylamine (DMAPA) on the reaction of MMA triazine with $H_2S$ is also exemplified. The invention is not to be limited by the examples, since it is submitted that these and other tertiary amines can catalyze the reaction of triazine/bisoxazolidine scavengers or aldehyde-based scavengers with $H_2S$.

EXAMPLES

Example I—To verify the potential positive effects of tertiary amines on the performance of triazine based $H_2S$ scavengers, $H_2S$ breakthrough tests were performed using 35% MMA triazine solutions, as the benchmark for the study.

$H_2S$ breakthrough tests are used to evaluate performance of scavenger solutions for application in bubble/contact towers. A schematic diagram of the test setup is shown in FIG. 1.

In each breakthrough test, a 50 mL sample of the $H_2S$ scavenger of interest was put in the contactor of the breakthrough apparatus. The sample was purged with a gas mixture containing 10% $H_2S$ (in nitrogen) at a flow rate of 211 mL/min. The scavenged gas, was then passed through a Drager tube. $H_2S$ slippage through the scavenger is recorded as a function of time. In this test, the "breakthrough time" is reported as the time required until the 0.2% (2000 ppm) reading level is reached on the Drager tube. Once breakthrough is observed, the test continues until the 7% reading on the Drager tube is reached. The tests were performed at 30° C.

Table 1 shows the breakthrough time for the 35% MMA triazine, 35% MMA triazine+1 TPA, 35% MMA triazine+1% DMAPA, and 35% MMA triazine+1% TEA samples. All testing was at 30° C.

TABLE 1

Breakthrough test results for 35% MMA Triazine

| Product | Temperature (° C.) | Breakthrough Time (min) | Scavenger Appearance Post-Test |
|---|---|---|---|
| 35% MMA Triazine | 30 | 9.3 | Clear colorless solution |
| 35% MMA Triazine + 1% TPA | 30 | 16.1 | Clear colorless solution |
| 35% MMA Triazine + 1% DMAPA | 30 | 33.0 | Clear colorless solution |
| 35% MMA Triazine + 1% TEA | 30 | 57.0 | Clear colorless solution |

The breakthrough time for the 35% MMA triazine, 35% MMA triazine+1% TPA, 35% MMA triazine+1% DMAPA, and 35% MMA triazine+1% TEA, under the test conditions, were measured as 9.3, 16.1, 33.0, and 57.0 minutes, respectively.

Figure 2:
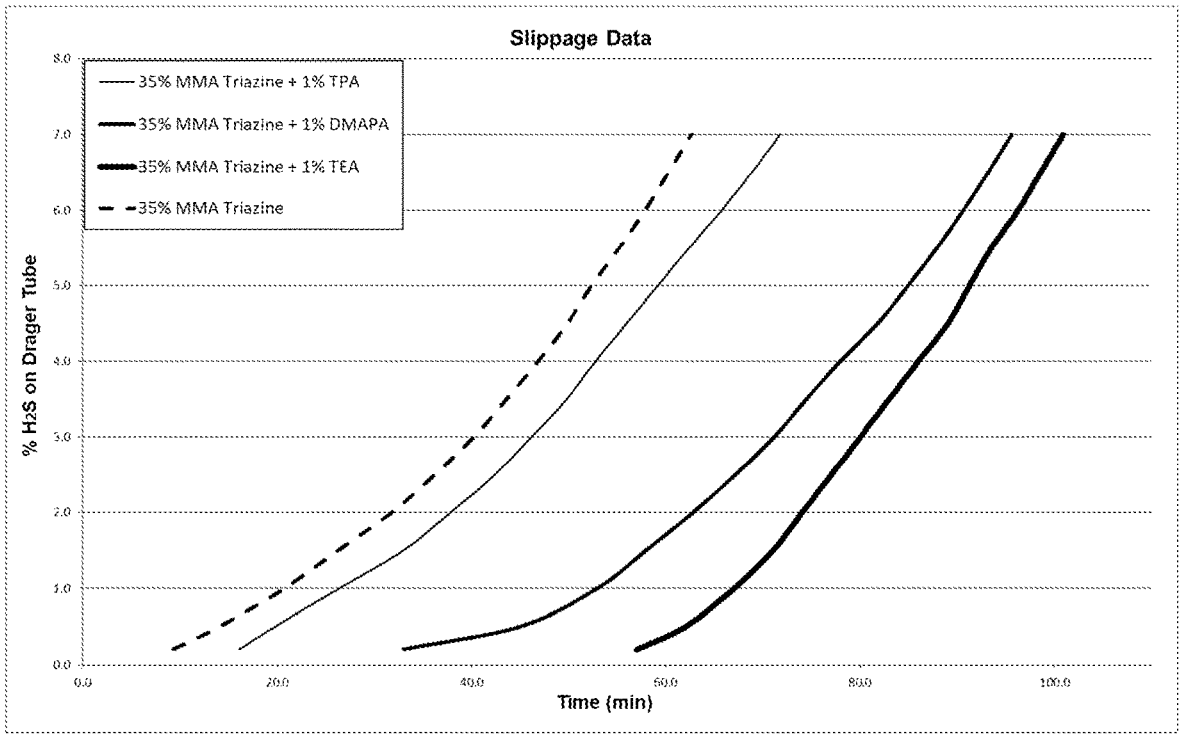
FIG. 2 shows slippage data for 35% MMA triazine scavenger solutions alone and catalyzed with tertiary amines according to Example I.

For the test a Drager tube with the range of 0.2-7% was used. After the initial breakthrough, observing the progression of the color change can give a qualitative indication towards the concentration of $H_2S$ slipping past the contactor. The slippage data are presented in the following table (Table 2) and in FIG. 2.

TABLE 2

Slippage data for 35% MMA Triazine

| Cumulative Reading (%) | 35% MMA Triazine (min) | 35% MMA Triazine + 1% TPA (min) | 35% MMA Triazine + 1% DMAPA (min) | 35% MMA Triazine + 1% TEA (min) |
|---|---|---|---|---|
| 0.2 | 9.3 | 16.1 | 33.0 | 57.0 |
| 0.5 | 14.1 | 19.8 | 45.0 | 62.0 |
| 1.0 | 20.8 | 26.4 | 53.0 | 67.0 |
| 1.5 | 26.3 | 33.0 | 58.0 | 71.0 |
| 2.0 | 31.8 | 37.8 | 62.8 | 74.0 |
| 2.5 | 36.3 | 42.4 | 67.2 | 77.0 |
| 3.0 | 40.3 | 46.1 | 71.2 | 80.0 |
| 3.5 | 43.6 | 49.8 | 74.5 | 83.0 |
| 4.0 | 46.9 | 52.8 | 78.0 | 86.0 |
| 4.5 | 49.9 | 56.0 | 81.9 | 89.1 |
| 5.0 | 52.4 | 59.2 | 85.0 | 91.3 |
| 5.5 | 55.3 | 62.4 | 88.0 | 93.5 |
| 6.0 | 57.9 | 65.8 | 90.7 | 96.3 |

TABLE 2-continued

| Slippage data for 35% MMA Triazine | | | | |
|---|---|---|---|---|
| Cumulative Reading (%) | 35% MMA Triazine (min) | 35% MMA Triazine + 1% TPA (min) | 35% MMA Triazine + 1% DMAPA (min) | 35% MMA Triazine + 1% TEA (min) |
| 6.5 | 60.3 | 68.8 | 93.2 | 98.6 |
| 7.0 | 62.6 | 71.7 | 95.6 | 100.9 |

As shown in the diagram, the presence of the amines has improved performance of the 35% MMA triazine, under the test conditions. TEA offered the best improvement.

All scavenger solutions were clear post-test, with no noticeable turbidity.

Figure 3:
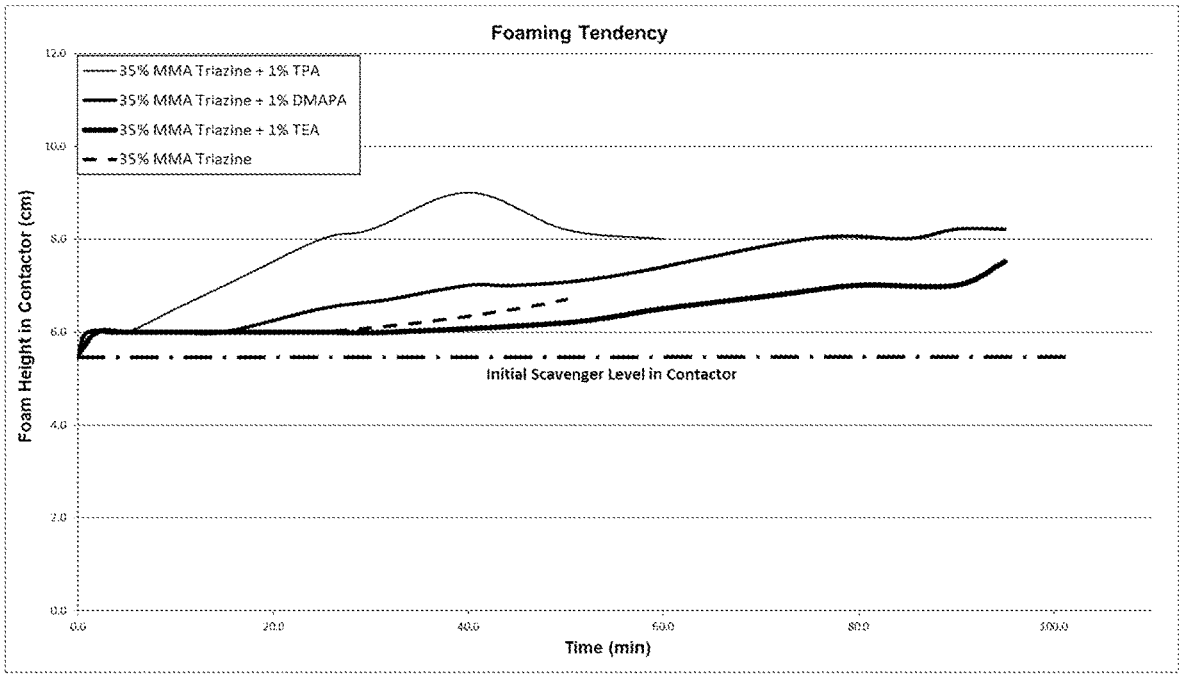
FIG. 3 shows foaming tendency of the 35% MMA triazine solutions during the course of the test.

FIG. 3 shows foaming tendency of the scavenger solutions during the course of the test. As shown, the presence of TPA, DMAPA, and TEA did not cause any significant change in foaming tendency of the 35% MMA triazine, under the test conditions.

Based on the test results, addition of low levels of TPA, DMAPA, and TEA each provided improved performance of MMA triazine scavenger. TPA showed the least improvement and TEA the most significant improvement. The amines did not cause any significant alterations in foaming tendency of the scavenger solutions, under the test conditions. The partially spent 35% MMA triazine solutions were clear post-test, with no noticeable turbidity.

Example II

Breakthrough testing, as described above, was repeated with 40% glyoxal solution and 40% glyoxal solution with 5% TEA.

Figure 4:
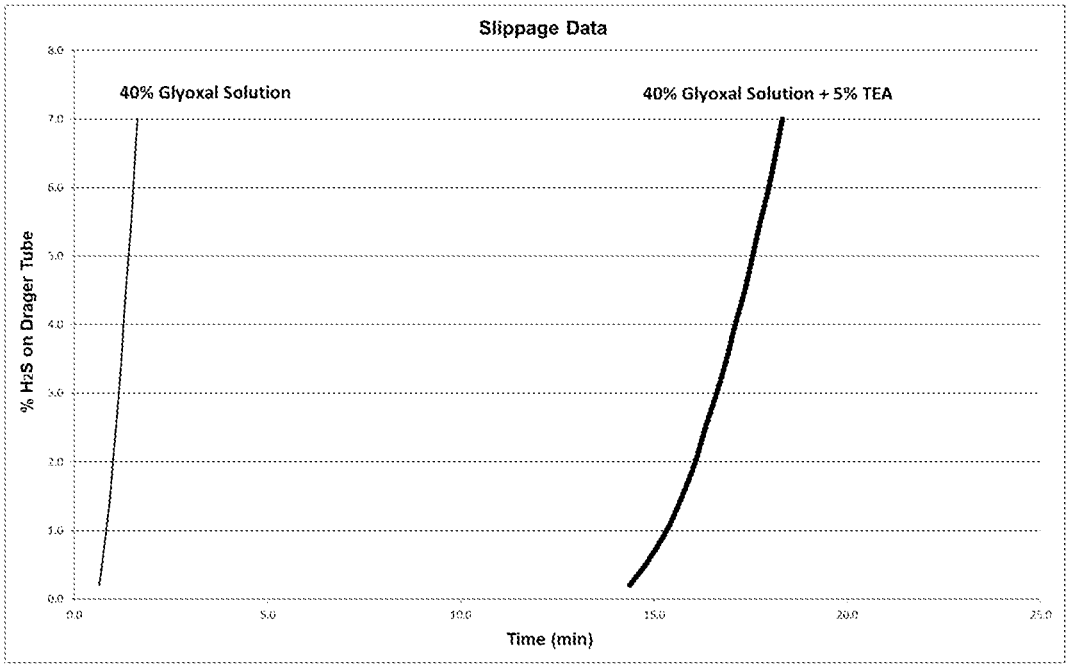
FIG. 4 shows slippage data from Example II for a 40% glyoxal scavenger solution alone and catalyzed with a tertiary amine.

Results are shown in FIG. 4. As noted above, the longer the time before $H_2S$ is detected, the better the scavenger performance.

Non-catalyzed glyoxal had a breakthrough time of ~30 seconds. 40% glyoxal catalyzed with 5% TEA had a breakthrough time of ~14 minutes.

Example III 15.2 mL of either 40% glyoxal solution or 40% glyoxal solution catalyzed with 1% TEA was placed in an autoclave. The autoclave was pressurized to 160 psi with $H_2S$.

The autoclave gauge pressure is recorded as a function of time. A pressure drop is indicative of consumption of $H_2S$.

A fast pressure drop is indicative of improved scavenger kinetics.

Figure 5:
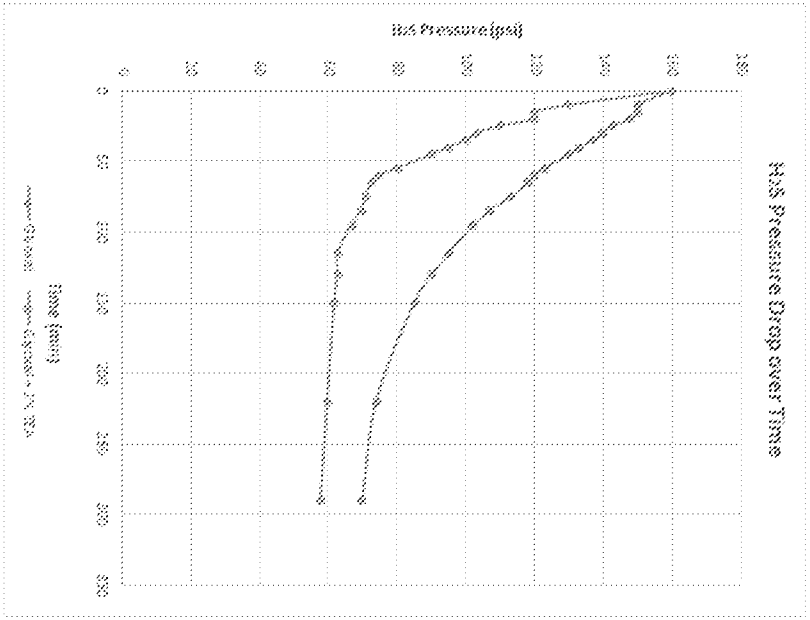
FIG. 5 shows the result of hydrogen sulfide pressure drop as a result of reactivity with a 40% glyoxal scavenger solution alone and catalyzed with a tertiary amine, as in Example III.

Results are shown in FIG. 5.

The autoclave pressure with 40% glyoxal solution dropped from 160 psi to 100 psi in ~100 minutes.

The autoclave pressure with 40% glyoxal solution catalyzed with 1% TEA dropped from 160 psi to 100 psi in ~30 minutes.

Based on the test results, addition of low levels of tertiary amines will improve the performance of glyoxal and potentially other aldehyde-based scavengers.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown or presented in the examples herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

The invention claimed is:

1. A hydrogen sulfide scavenging composition comprising:

(a) a compound selected from the group consisting of: methyl amine triazine, C2-C5 alkyl amine triazine, dimethylaminopropylamine triazine, isopropanolamine triazine, aniline triazine, cyclohexylamine triazine, isobutanolamine triazine, methoxypropylamine triazine and isopropanolamine bisoxazolidine, and;

(b) a tertiary amine, wherein the tertiary amine has a concentration of 0.05 to 8.0% by volume of the volume of the hydrogen sulfide scavenging composition.

2. The composition according to claim 1 wherein the compound (a) is methyl amine triazine, dimethylaminopropylamine triazine, isopropanolamine triazine or isopropanolamine bisoxazolidine.

3. The composition of claim 1 wherein the tertiary amine is selected from the group consisting of: triethylamine (TEA), tripropylamine (TPA), tributylamine (TBA) and dimethylaminopropylamine (DMAPA).

4. The composition of claim 1 wherein the tertiary amine has a concentration of 0.1 to 5.5% by volume of the volume of the hydrogen sulfide scavenging composition.

5. A method for scavenging hydrogen sulfide from a hydrocarbon fluid comprising:

contacting the hydrocarbon fluid with a hydrogen sulfide scavenging composition comprising:

(a) a compound selected from the group consisting of: methyl amine triazine, C2-C5 alkyl amine triazine, dimethylaminopropylamine triazine, isopropanolamine triazine, aniline triazine, cyclohexylamine triazine, isobutanolamine triazine, methoxypropylamine triazine and isopropanolamine bisoxazolidine, and;

(b) a tertiary amine, wherein the tertiary amine has a concentration of 0.05 to 8.0% by volume of the volume of the hydrogen sulfide scavenging composition.

6. The method according to claim 5 wherein the compound (a) is methyl amine triazine, dimethylaminopropylamine triazine, isopropanolamine triazine or isopropanolamine bisoxazolidine.

7. The method according to claim 5 wherein the tertiary amine is selected from the group consisting of: triethylamine (TEA), tripropylamine (TPA), tributylamine (TBA) and dimethylaminopropylamine (DMAPA).

8. The method according to claim 5 wherein the tertiary amine has a concentration of 0.1 to 5.5% by volume of the volume of the hydrogen sulfide scavenging composition.

* * * * *